US005758885A

United States Patent [19]

Lowe

[11] Patent Number: 5,758,885

[45] Date of Patent: Jun. 2, 1998

[54] BRAKE SYSTEM FOR IN-LINE ROLLER SKATES

[76] Inventor: Garfield Lowe, 3701 Eureka St. Lot 2-D, Anchorage, Ak. 99503

[21] Appl. No.: 593,457

[22] Filed: Jan. 29, 1996

[51] Int. Cl.[6] ..... A63C 17/14

[52] U.S. Cl. ..... 280/11.2; 280/11.22

[58] Field of Search ..... 280/11.2, 11.22, 280/11.23; 188/77 R, 2 D

[56] References Cited

U.S. PATENT DOCUMENTS

| | | | |
|---|---|---|---|
| 1,497,224 | 6/1924 | Ormiston | 280/11.2 |
| 1,552,541 | 9/1925 | Clark | 280/11.2 |
| 5,052,524 | 10/1991 | Husted | 188/77 R |
| 5,143,387 | 9/1992 | Colla | 280/11.22 |
| 5,253,882 | 10/1993 | Mitchell | 280/11.2 |
| 5,351,974 | 10/1994 | Cech | 188/77 R |
| 5,388,844 | 2/1995 | Pellegrine, Jr. et al. | 280/11.2 |
| 5,415,419 | 5/1995 | Borque | 188/2 D |
| 5,464,235 | 11/1995 | Goldman et al. | 280/11.2 |

FOREIGN PATENT DOCUMENTS

| | | | |
|---|---|---|---|
| 1104413 | 11/1955 | France | 280/11.2 |
| 2925555 | 1/1981 | Germany | 280/11.2 |
| 315615 | 3/1934 | Italy | 280/11.23 |

*Primary Examiner*—Brian L. Johnson
*Assistant Examiner*—Frank Vanaman
*Attorney, Agent, or Firm*—Michael J. Tavella

[57] ABSTRACT

A braking system for in-line skates that uses a cable-pulley system. The device uses a closed loop of cable that is placed over pulleys on the skate wheels. In between each wheel set is a pair of lever arms. Each lever arm has a pair of grooves. The cable loop corresponding to a particular lever arm fits into the pair of grooves in the lever arm. To activate the brake, the rider allows the brake skate to go ahead of the other skate. This action causes the cuff of the boot to pivot and push down on the heel lever, which causes the sliding plate to move forward or backward (depending on whether the skater is skating forward or backward). This movement causes the lever arms to pitch forward (or backward), causing the cable loops to tighten against the pulleys, thereby creating a braking action. Braking action can be done in either a forward or reverse direction. This design has a minimal number of parts, has a low maintenance operation, uses inexpensive components, can be quickly assembled, has long brake life, has braking for all four wheels, has either forward or reverse cuff actuation, and has easy and fast interchangeability of skate components.

15 Claims, 15 Drawing Sheets

BRAKE SYSTEM FOR IN-LINE ROLLER SKATES

This invention relates to brake system for in line roller skates and particularly to brake system for in line roller skates using cables for braking.

BACKGROUND OF THE INVENTION

In recent years in-line roller skates have become more popular than the older wheel-pair type roller skates. In-line skates have a number of wheels that are placed in a line under a boot. The action of in-line skates is similar to ice skates. However, stopping on ice skates is much different from in-line roller skates.

Braking systems for in-line skates have been developed as the skates have developed. Examples of such systems are found in following U.S. Patents: U.S. Pat. No. 5,135,244 to Allison teaches an in-line skate in which the wheels are mounted on a rocker arm. A leaf spring that is larger than the boot is attached to the sole of the boot. To brake, the rider pivots his foot either forward or back until the leaf spring touches the front or back wheel. The problem with this design is that the braking action is confined to either the front or back wheel. Such a design does not give good braking power. Moreover, in certain situations, braking on the front wheel may pitch the rider forward, causing a crash. Finally, to use the brake at least two of the wheels are lifted from the ground. This leaves the rider standing on only two wheels. Such a stance is unstable. Another brake design is found in U.S. Pat. No. 5,232,231 to Carlsmith. This design used a number of brake pads that are placed adjacent to the wheels. The boot is modified so that the sole is resting on a coil spring. When the rider wants to brake, he pushes down with his heel, which causes the brake pads to move forward against brake drums that are attached to the wheels. Although this is an improvement over the previous patent, it still has flaws. The brake pads are shown as narrow pads that are perpendicular to the wheels. Moreover, the brake pads wear down quickly, requiring frequent replacement or adjustment. Finally, the wear on the brake pads is such that pad failure could result. If that occurs, it may be difficult to stop quickly when necessary.

U.S. Pat. No. 5,316,325 to Mitchell et al. Teaches a brake pad that is attached to the heel of the boot but does not contact the wheels. This pad is controlled by the rider, who must raise his toe and push down with his heel. In doing so, the rider causes the brake pad to push against the ground behind the skate. This is clearly an improvement over the other brakes mentioned above. However, it too has its faults. The problem is that such braking causes friction that wears against the pad, causing frequent replacement. Moreover, as the pad wears, braking action is impaired without adjustment.

Finally, U.S. Pat. No. 5,342,071 to Soo teaches a skate that has two sets of wheels mounted on rocker arms. Brake pads are provided on the front and the rear wheels, much like those of the Allison patent, described above. Because this design is similar to the Allison design, it has the same flaws.

All the brakes described above rely on friction created by rubbing a pad against either a drum or the ground to produce braking action. There is at least one other type of friction brake system-one that uses cables or pads passing around a drum or pulley. Examples of this design are U.S. Pat. No. 3,828,895 that has a pad fixed around a drum. The brake is operated by a cable actuator that pulls the ends of the pad together, thereby causing the pad to rub against the drum.

Additional examples of similar brakes are found in U.S. Pat. Nos. 3,583,531, 4,487,294, 4,591,027, 4,882,844, and 4,757,881.

Although this type of brake is useful in specific applications, several modifications are needed before it can be applied to in-line skates.

SUMMARY OF THE INVENTION

The instant invention is a braking system for in-line skates that uses the cable-drum system in a unique manner. The invention uses a closed loop of cable that is placed over pulleys on the skate wheels. In this design every skate wheel has two pulleys. Four wheels are used in this design, making two two-wheel sets. One pair of cables is used for each two-wheel set. Thus, four cables in total are needed. The cable loops are passed over and placed in the pulleys. In between each wheel set is a pair if lever arms. Each lever arm has a pair of grooves. The cable loop corresponding to a particular lever arm fits into the pair of grooves in the lever arm. The lever arms are moved by a sliding plate at the sole of the boot. The sliding plate is attached to a heel lever that is attached to the boot. To activate the brake, the rider allows the brake skate to go ahead of the other skate. This action causes the cuff of the boot to pivot and push down on the heel lever, which causes the sliding plate to move forward or backward (depending on whether the skater is skating forward or backward). This movement causes the lever arms to pitch forward (or backward), causing the cable loops to tighten against the pulleys, thereby creating a braking action. This braking action is accomplished whether the skater is moving forward or backward. Because this braking action is applied uniformly to all wheels simultaneously, it is inherently stable. Moreover, since all the wheels remain on the ground surface during braking, the brake is safer.

In short, this design has a minimal number of parts, has a low maintenance operation, uses inexpensive components, can be quickly assembled, has long brake life, provides braking for all four wheels, provides both forward and reverse cuff actuation, and has easy and fast interchangeability of skate components.

It is an object of the invention to produce a brake system for in-line skates that applies uniform braking force to all wheels simultaneously.

It is another object of the invention to produce a brake system for in-line skates that uses components that have a longer operating life than standard brake pads.

It is yet a further object of the invention to produce a brake system for in-line skates that does not wear against the surfaces of the wheels that contact the ground.

It is another object of the invention to produce a brake system for in-line skates that permits the rider to keep all wheels on the ground for braking.

It is yet a further object of the invention to produce a brake system for in-line skates that has a minimal number of parts.

It is yet a further object of the invention to produce a brake system for in-line skates that has a low maintenance operation.

It is yet a further object of the invention to produce a brake system for in-line skates that uses inexpensive components.

It is yet a further object of the invention to produce a brake system for in-line skates that can be quickly assembled.

It is yet a further object of the invention to produce a brake system for in-line skates that provides both forward and reverse cuff actuation.

It is yet a further object of the invention to produce a brake system for in-line skates that has easy and fast interchangeability of skate components.

DETAILED DESCRIPTION OF THE INVENTION

Figure 1:
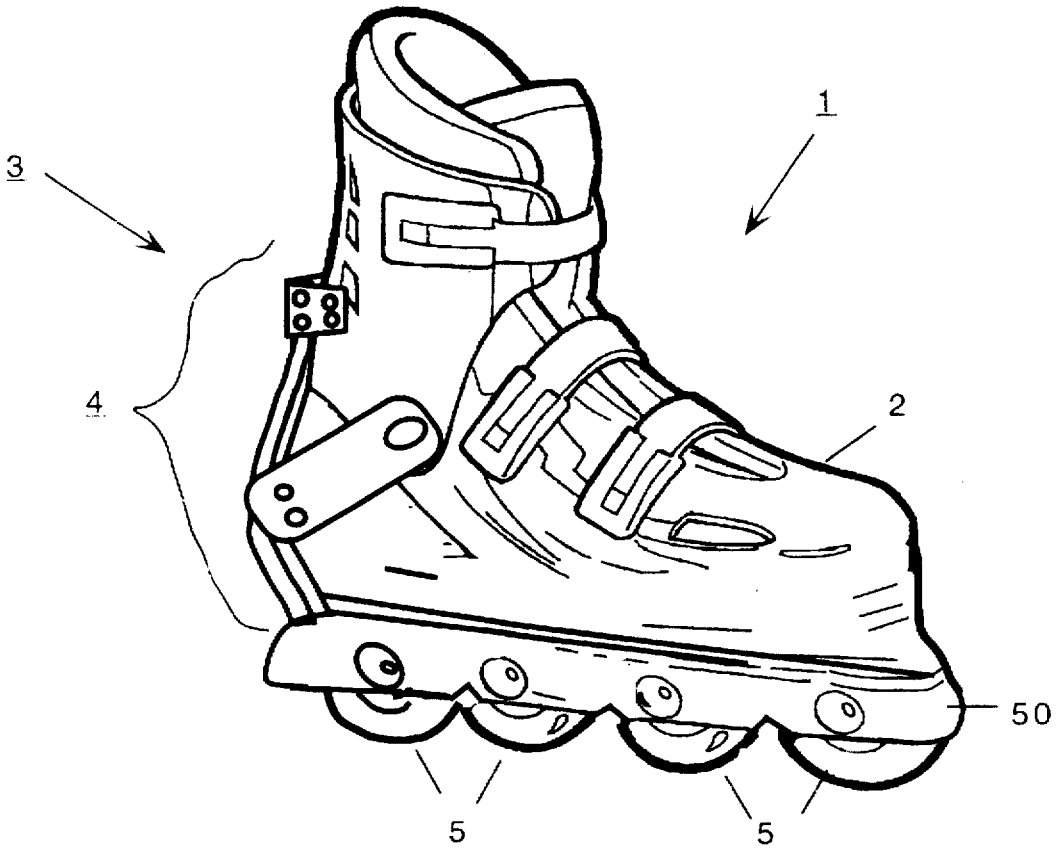
FIG. 1 is a perspective view of the invention.
Figure 2:
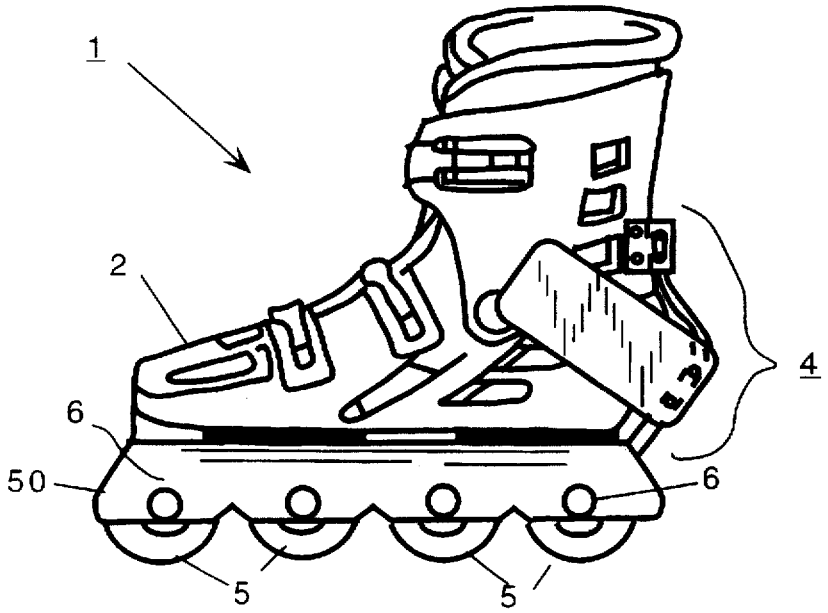
FIG. 2 is a side view of the invention.

Referring now to FIG. 1, the invention 1 is shown. In this view, the in-line skate 1 has an upper boot 2 that is, for the most part, made like any in-line skate boot. One main difference is the heel section 3 that has the cuff actuator 4 for the brake. The skate 1 has four wheels 5 that are mounted on axles 6 that are secured to the boot 2 with bolts and nuts. See also, FIG. 2.

Figure 3:
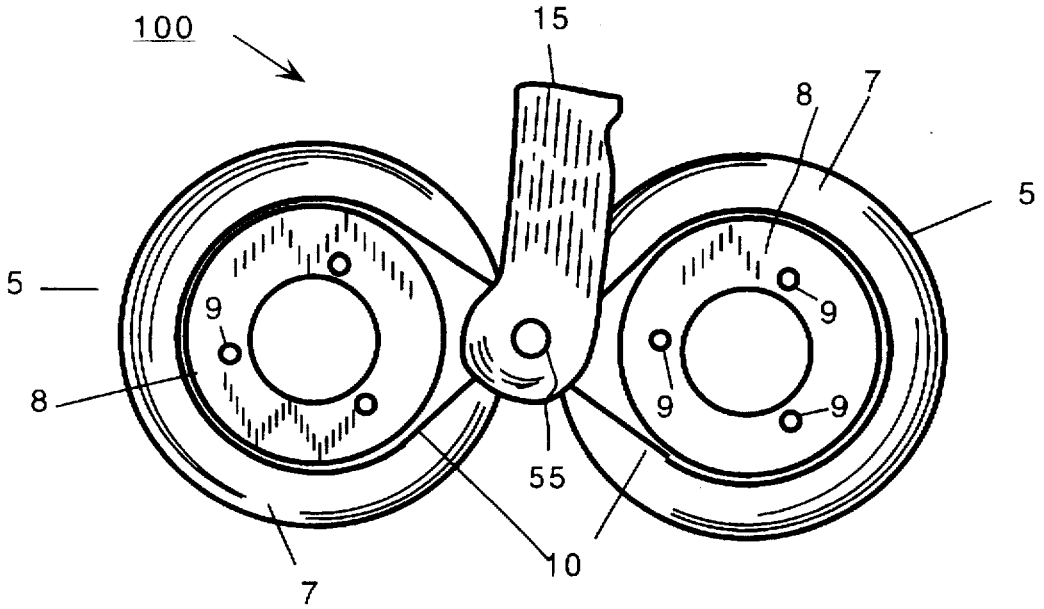
FIG. 3 is a side view showing one of the cable drum systems as mounted to a pair of wheels.
Figure 13:
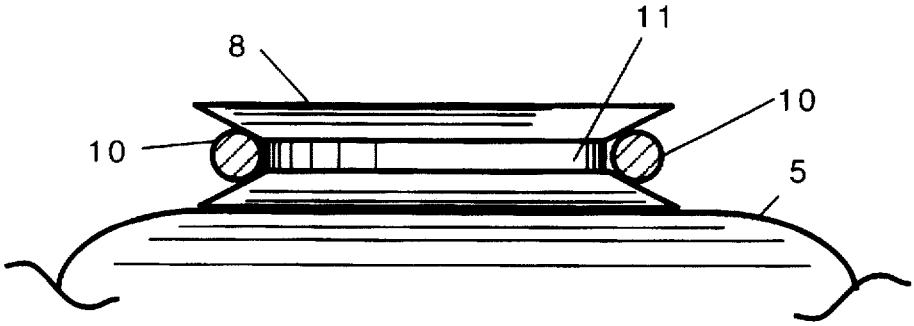
FIG. 13 is a top detail view of a typical pulley.

Referring now to FIG. 3, one of the sub assemblies of the braking system, an operating mechanism 100 is shown. FIG. 3 shows a pair of wheels 5. The wheels 5 are round and have a flat side surface 7. A brake drum pulley 8 is attached to each wheel 5 as shown, using pins or screws 9. A cable 10 is placed over the pulley 8. Each pulley 8 has a channel 11 formed in it to receive the cable 10 (see FIG. 13). A brake operating lever 15 is attached to the cable 10 as shown in FIG. 3. See also FIGS. 6 and 7 for details of this operating lever, which is discussed in more detail below. For each wheel pair, this assembly is duplicated on the other side of the wheels. Thus, this brake set is mounted in pairs on each two wheel set. See FIGS. 14–16.

Figure 17:
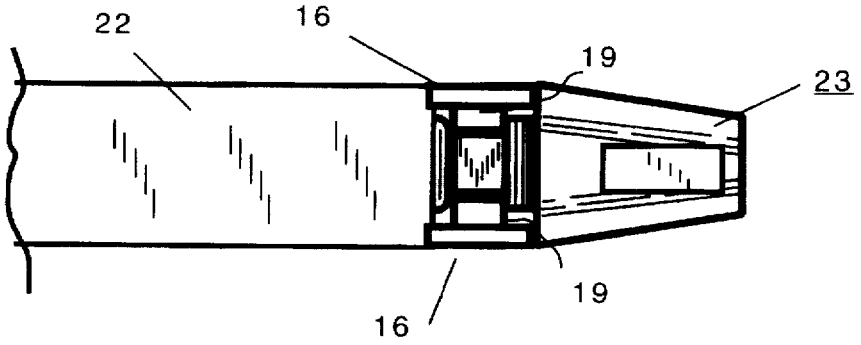
FIG. 17 is an enlarged detail view of the brake arm with one set of the brake levers in place.

Each operating lever 15 is interlocked with a brake arm 20. The brake arm 20 is shown in detail in FIGS. 8–10. The details of the connection between the operating levers 15 and the brake arm 20 is shown in FIG. 17.

Figure 4:
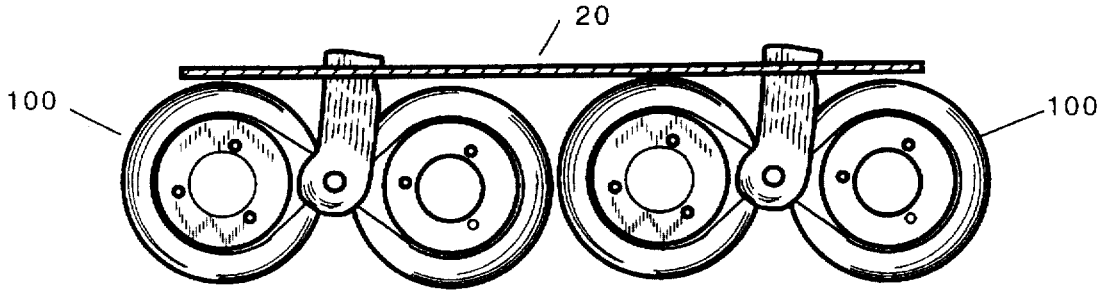
FIG. 4 is a side view of one set of the cable drum systems and braking arm in the neutral position
Figure 5:
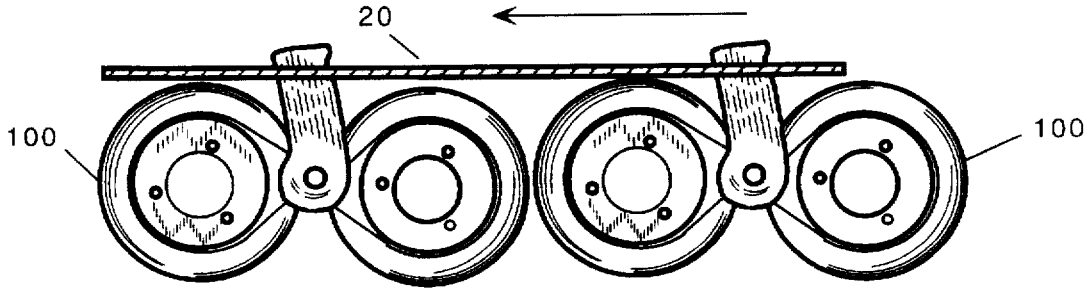
FIG. 5 is a side view of one set of the cable drum systems and braking arm in the engaged position.

The brake arm 20, as discussed below connects to the heel-operated cuff actuator 4, which is discussed in greater detail below. When the heel-operated cuff actuator 4 is engaged, the brake arm 20 is moved forward from the neutral position, as shown in FIG. 4, to the engaged position, as shown in FIG. 5. In the engaged position, the operating levers 15 tighten the cable 10, thereby causing the cable 10 to tighten against the pulleys 8, thereby stopping the wheels 5 in a gradual, safe manner.

Figure 6:
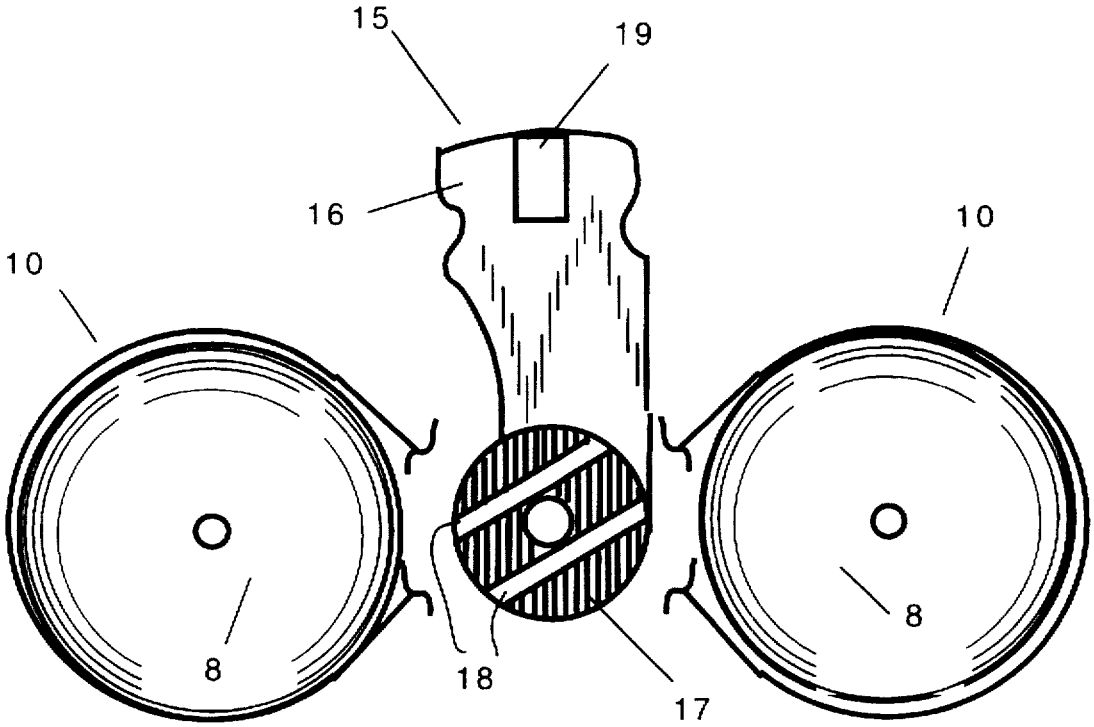
FIG. 6 is a side view of the one of the operating arm-brake systems in the neutral position.
Figure 7:
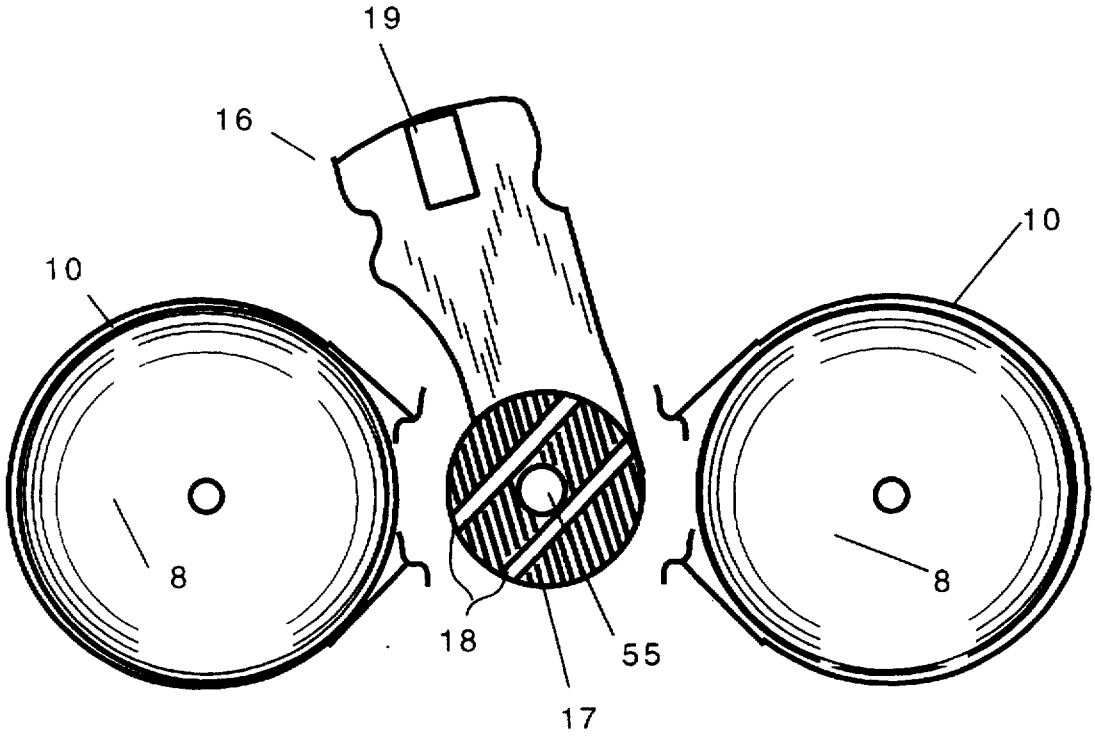
FIG. 7 is a side detail view of one of the operating arm-brake system in the engaged position.

FIGS. 6 and 7 show details of the tightening operation of the operating levers 15. FIG. 6 shows the reverse side of one set of the brake pulleys 7 removed from the wheels 5. This view also shows the details of the operating levers 15. Each operating lever 15 is a molded form that has an upper portion 16 and a lower portion 17. The lower portion 17 has a pair of grooves 18 formed in the body of the lower portion 17. (Note that the cable 10 is shown cut to clearly show the grooves 18.) The grooves 18 hold the cable 10 within the operating lever 15. When the brake system is engaged, the operating arm 15 rotates as shown in FIG. 7. This rotation causes the cable 10 to bear down on the brake pulleys 8, thereby causing the wheels 5 to slow their rotation.

Tn the neutral position (FIG. 6), the cable 10 does not rotate about the pulleys 8. The pulleys 8 rotate freely under the cable 10 while the cable 10 stays in place. When the brakes are engaged, the cable 10 simply constricts against the channel 11 (see FIG. 13) of the brake pulley 8.

Figure 20:
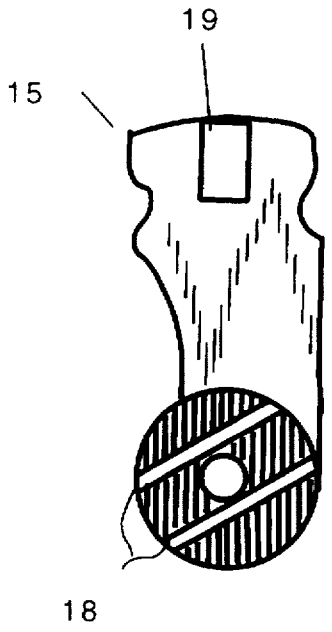
FIG. 20 is a detail view of the brake lever in the preferred embodiment.
Figure 21:
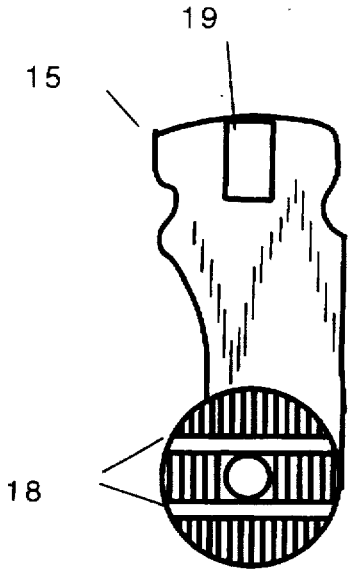
FIG. 21 is a detail view of the brake lever in an alternative embodiment.

FIG. 20 shows details of the brake lever 15 as used in the preferred embodiment, in this embodiment, the grooves 18 are shown at an angle. FIG. 21 shows the brake lever 15 where the grooves 18 are not angles with respect to the brake lever 15. This configuration is most suitable for two-way braking (both forward and reverse movement of the brake arm 20). The level grooves 18 in this embodiment allow the two-way braking action to be much smoother. However, this groove alignment has a problem in that if the cables 10 stretch or are not tight, the level grooves 18 allow too much play in the cables 10, thereby reducing brake effectiveness.

At the top of each operating lever 15 is a tab 19 that extends outward from the operating lever 15 as shown. This tab 19 engages the brake arm 20, as discussed below.

Figure 8:
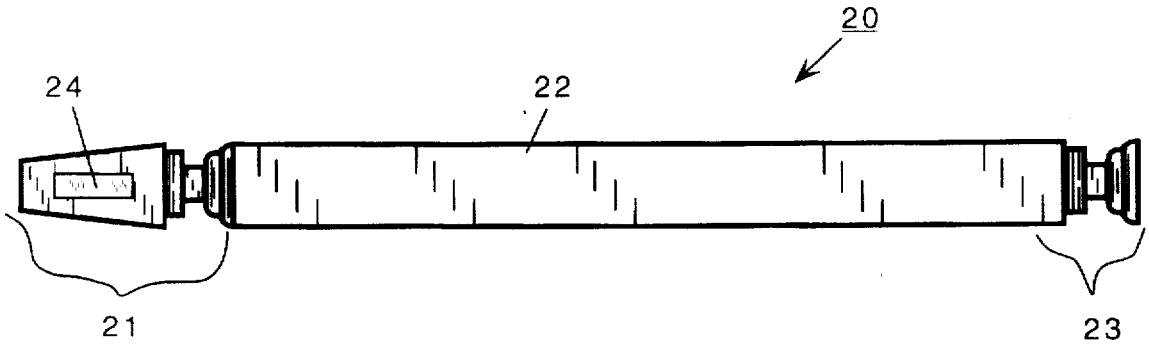
FIG. 8 is a top view of the braking arm.
Figure 9:
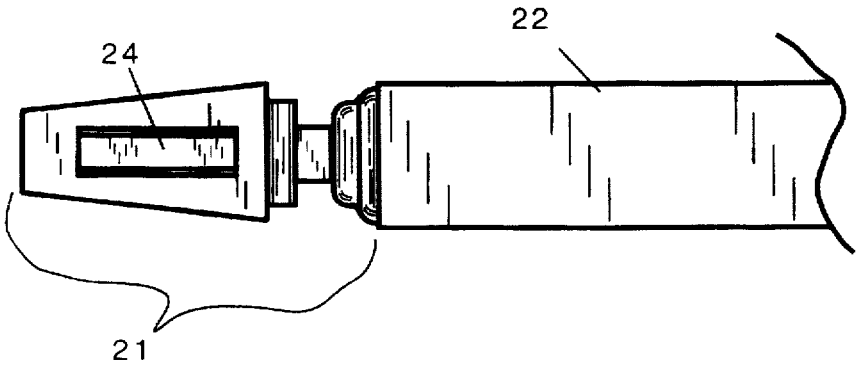
FIG. 9 is a detail view of one end of the braking arm
Figure 10:
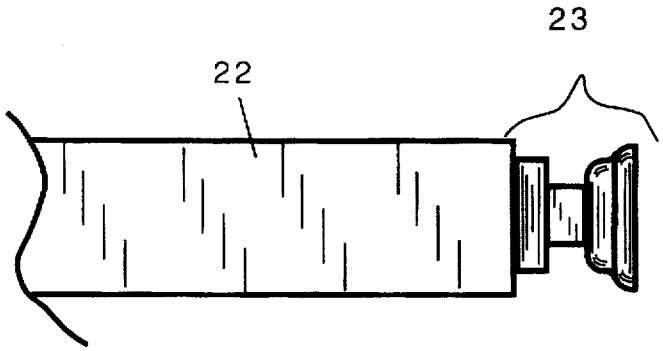
FIG. 10 is a detail view of the other end of the braking arm.

As discussed above, a sliding brake arm 20 is attached to the tab 19 at the top portion 16 of the operating levers 15. FIGS. 8, 9 and 10 show details of the brake arm 20. FIG. 8 is a top view of the brake arm 20. The brake arm 20 has three main parts: a formed front 21, a rectangular center portion 22 and a formed end piece 23. FIG. 9 is a detail view of the formed front 21. FIG. 10 is a detail view of the end piece 23. FIGS. 8 and 9 also show a pair of flanges 24 are shown, attached to the formed front 21 of the brake arm 20. These flanges 24 are used to attach the brake arm 20 to the cuff actuator 4 as discussed below.

FIG. 17 is a detail view of the connection between the brake arm 20 and the operating levers 15. It shows how the tabs 19 interlock with the formed end piece 23. The forward operating levers 15 interlock with the formed front 21 in an identical manner.

Figure 11:
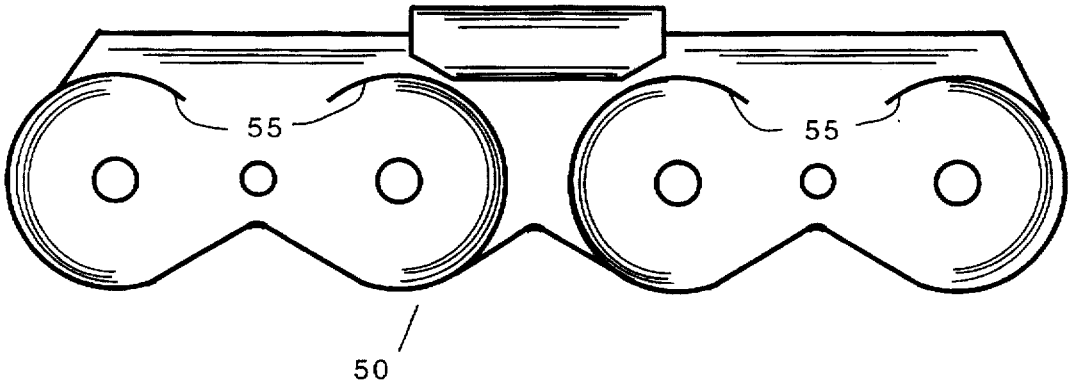
FIG. 11 is a side view of a brake drum housing.
Figure 12:
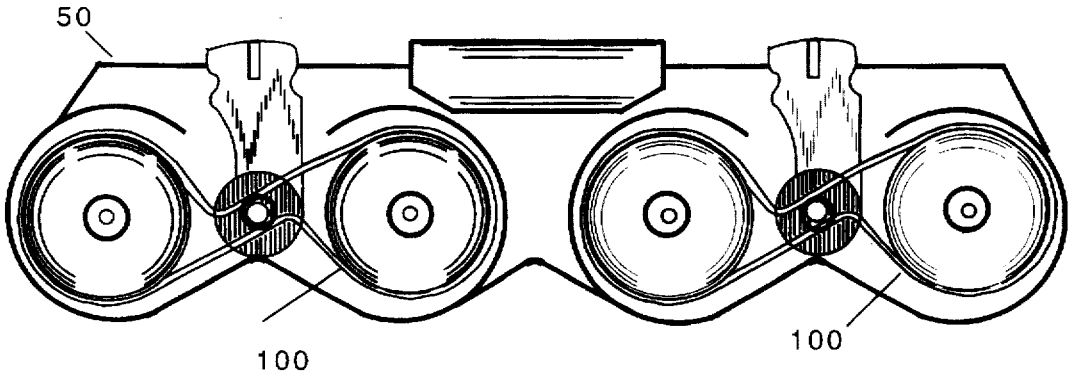
FIG. 12 is a side view of the operating mechanism of the invention mounted in a brake drum housing, in the neutral position.

FIG. 11 shows a side view of one brake housing 50. This is a formed piece of plastic or similar material that fits up against the brake pulleys 7 and the operating levers 15. The brake housings 50 have four curved flanges 55 that extend outward from the brake housing 50. The flanges 55 are designed to restrain the cable 10 when they are installed in the brake housings (as discussed below). The flanges 55 also act to self center the cables 10 and the operating mechanisms 100. FIG. 12 shows a pair of operating mechanisms 100 placed in the housing. In practice, two brake housings 50 are used. See FIGS. 15 and 16. The brake arm 20 rests on top of the brake drum housings 50, as shown in FIG. 16.

Figure 14:
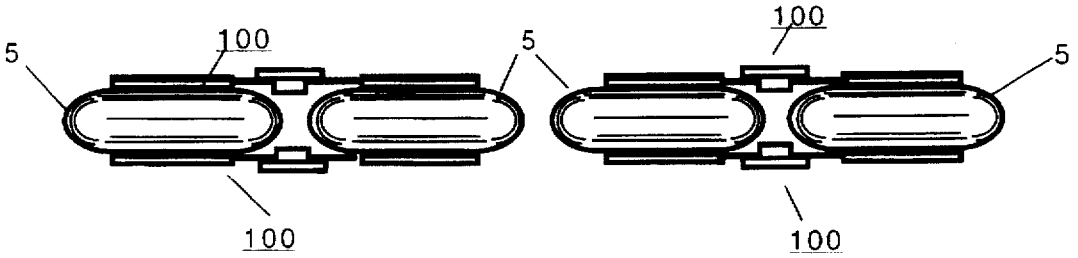
FIG. 14 is a top view of the wheel sets with the brake systems installed.

Referring now to FIG. 14, a pair of wheel sets and the operating mechanism 100 are shown as they are assembled in practice. Note that there are two sets of operating mechanisms 100 attached to each wheel pair. This ensures smooth, even braking and a redundancy should one of the cables 10 fail.

Figure 15:
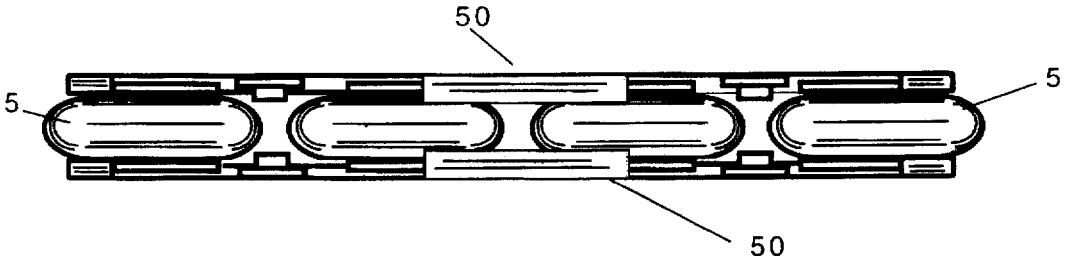
FIG. 15 is a top view of the wheel sets with the brake systems installed, placed in the brake housings.

FIG. 15 shows the assembled wheel pairs placed within the two brake housings 50. The brake housings 50 are aligned to the assembled wheel pairs by pins and are held on the wheel assemblies by the axle bolts.

Figure 16:
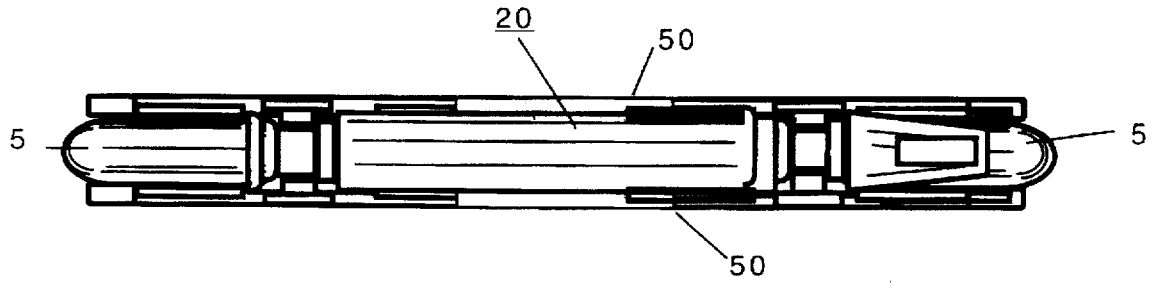
FIG. 16 is a top view of the wheel sets with the brake systems installed in the brake housings and the brake arm in place.

FIG. 16 shows the brake arm 20 in place over the brake housings 50.

FIG. 17, as discussed above shows the details of the connection between the operating levers 15 and the brake arm 20.

Figure 18:
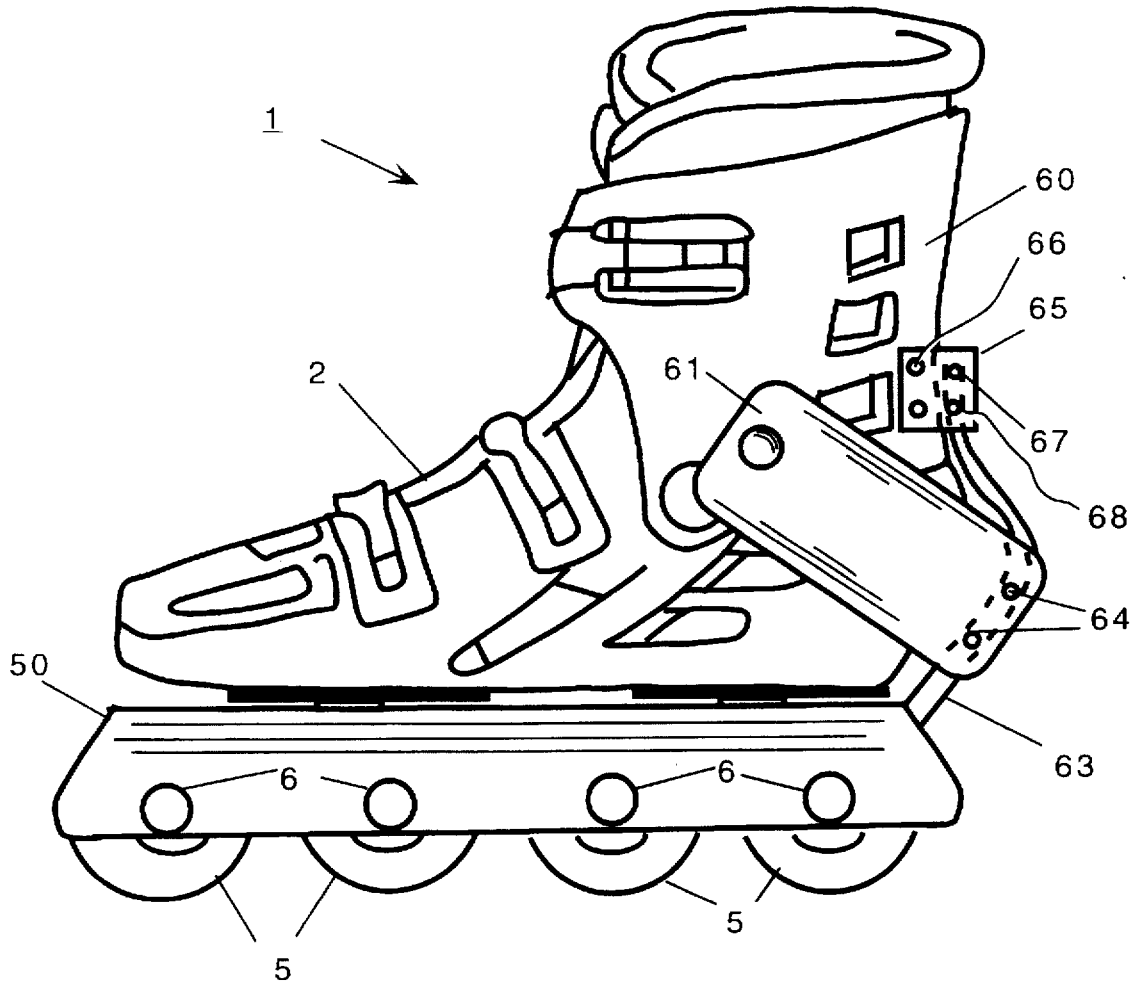
FIG. 18 is a side view of the invention showing details of the actuator cuff.
Figure 19:
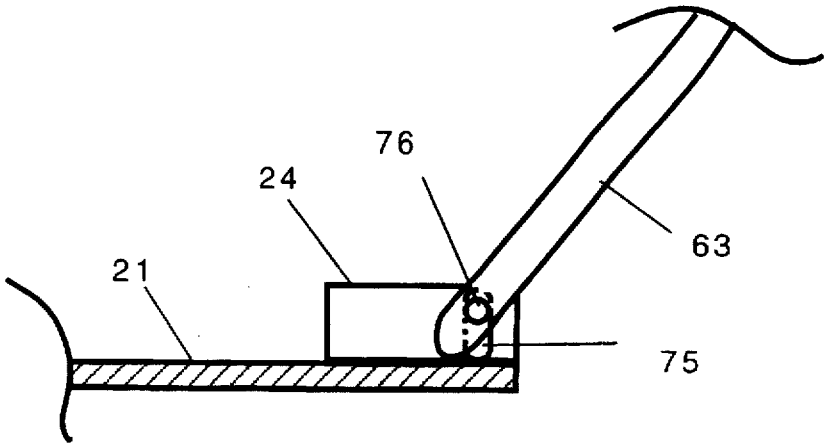
FIG. 19 is a detail view of the connection of the brake actuator lever and the brake arm.

FIG. 18 shows a side view of the invention 1 that shows the operation of the cuff actuator 4. This assembly has a pivoting body 60 that encircles the back portion of the boot 2. A pivot arm 61 is attached to the pivoting body 60 as shown. The pivot arm 61 is a "U" shaped member that wraps around the pivoting body 60. The pivot arm 61 is attached to the pivoting body 60 by bolts or adhesive, or other means common to the art. The pivot arm 61 is attached rigidly to the pivoting body 60, so the pivot arm 61 moves in concert with the pivoting body 60. The pivot arm 61 extends outward and rearward from the boot 2 as shown. A pivot shaft 63 is attached to the closed end of the pivot arm 61 as shown, using bolts 64, or similar fasteners. The top end of the pivot shaft 63 is attached to a bracket 65. The pivot shaft 63 is attached to the bracket 65 using only one pin 67. A number of holes 68 are provided to establish the best connection point for the pivot shaft 63. Although only two holes 68 are shown, more can be added as desired. The bracket 65 is attached to the pivot body 60 by rivets 66 as shown. The other end of the pivot shaft 63 is attached to the flange 24 on the brake arm 20. FIG. 19 shows this connection. The pivot shaft 63 is attached to the flange 24 by a pin 76. The pin 76 rides in a slot 75 that is formed in the flange 24. The slot 75 works to allow the pivot shaft 63 to move without causing the brake arm 20 to flex. This arrangement causes the brake arm 20 to move laterally back and forth as the pivot shaft 63 is rotated. As discussed above, this sliding action causes the brakes to become engaged or disengaged as needed for stopping.

To activate the brake, the rider allows the brake skate to go forward of the other skate. This action causes the rider to push down on the heel lever, which causes the sliding plate to move forward. This movement causes the lever arms to pitch forward, causing the cables 10 to tighten against the pulleys 8, thereby creating a braking action. Because this braking action is applied uniformly to all wheels simultaneously, it is inherently stable.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A braking system for in-line skates comprising:

a) boot, having a forward end and a reward end;

b) plurality of wheels, rotatably attached to said boot;

c) a brake operating mechanism, operably attached to said plurality of wheels, said brake operating mechanism including:

i) at least one pulley, fixedly attached to one wheel of the plurality of wheels, ii) a cable, slidably placed around said pulley, and iii) a means for providing tension on said cable, operably attached to said boot, such that as said cable is tensioned, said cable applies a frictional force to said pulley, thereby producing a braking action; and d) a means for operably engaging said means for providing tension on said cable, operably attached to said boot.

2. The braking system for in-line skates of claim 1 wherein the means for operably engaging said means for providing tension can be activated by moving said means for operably engaging toward said forward end of said boot.

3. The braking system for in-line skates of claim 1 wherein the means for operably engaging said means for providing tension can be activated by moving said means for operably engaging toward said rearward end of said boot.

4. The braking system of claim 1 wherein said means for providing tension of said cable comprise:

a) a brake arm, slidably attached to said boot;

b) a lever arm, pivotably attached to said brake arm and being fixedly attached to said cable such that when said lever arm is pivoted, said cable becomes constricted about said pulley, thereby creating a braking force.

5. The braking system for in-line skates of claim 4 wherein the means for operably engaging said means for providing tension on said cable comprise: an actuator lever means having two ends, a first end, being pivotably attached to said boot, and a second end, being attached to said brake arm; and a means for pivoting said actuator lever means, such that as said actuator lever means is pivoted, said brake arm is moved in a linear motion.

6. A braking system for in-line skates comprising:

a) a boot, having a forward end and a rearward end;

b) a pair of wheel sets, rotatably attached to said boot, each wheel set having two wheels;

c) a pair of brake operating mechanisms, operably attached to said pair of wheel sets, each brake operating mechanism including:

i) two pulleys, fixedly attached to each wheel set, in linear alignment, ii) a cable, slidably placed around the two pulleys, and iii) a means for providing tension on said cable such that as said cable is tensioned, said cable applies a frictional force to the two pulleys, thereby producing a braking action on each wheel set; and d) a means for operably engaging said means for providing tension on said cable, operably attached to said boot.

7. The braking system for in-line skates of claim 6 wherein the means for operably engaging said means for providing tension can be activated by moving said means for operably engaging toward said forward end of said boot.

8. The braking system for in-line skates of claim 6 wherein the means for operably engaging said means for providing tension can be activated by moving said means for operably engaging toward said rearward end of said boot.

9. The braking system of claim 6 wherein said means for providing tension of said cable comprise:

a) a brake arm, slidably attached to said boot;

b) a lever arm, pivotably attached to said brake arm and being fixedly attached to said cable such that when said lever arm is pivoted, said cable becomes constricted about said pair of pulleys, thereby creating a braking force.

10. The braking system for in-line skates of claim 9 wherein the means for operably engaging said means for providing tension on said cable comprise: an actuator lever means having a first end, being pivotably attached to said boot, and a second end, being attached to said brake arm; and a means for pivoting said actuator lever means, such that as said actuator lever means is pivoted, said brake arm is moved in a linear motion.

11. A braking system for in-line skates comprising:

a) a boot, said boot having a forward end and a rearward end, and a cuff, pivotably attached to said boot;

b) a pair of wheel sets, rotatably attached to said boot, each wheel set having two wheels, each wheel set having a first side and a second side;

c) a brake actuator lever, fixedly attached to said cuff, whereby as said cuff is pivoted, said brake actuator lever is pivoted in like motion;

d) a brake arm, fixedly attached to said brake actuator lever;

e) a first brake housing and a second brake housing, removably placed about said pair of wheel sets, said first and second brake housings being connected and forming a single unit having a flat top, whereby said brake arm is slidably positioned on said flat top of said first and second brake housings;

f) a first brake operating mechanism and a second break operating mechanism, wherein said first brake operating mechanism is removably installed within said first brake housing and said second brake operating mechanism is removably installed within said second brake housing, said first and second brake operating mechanisms each having a first brake system and a second brake system, said first brake system being operably attached to said first side of each wheel set, said second brake system being operably attached to said second side of each wheel set and being oppositely disposed on each wheel set from said first brake system, said first and second brake systems each including:

i) two pulleys in linear alignment, ii) a cable, slidably placed around the two pulleys, and iii) a brake lever, fixedly attached to said cable and having a top, said top of said brake lever having a tab, said brake lever also having a pair of grooves to receive said cable;

d) wherein said brake lever is attached to said brake arm such that as said brake arm is engaged in linear motion, said brake lever is pivoted, thereby causing said cable to become constricted against the two pulleys, thereby causing a braking action.

12. The braking system for in-line skates of claim 11 wherein the brake lever of said first brake system is pivotably attached to said first brake housing and the brake lever of said second brake system is pivotably attached to said second brake housing.

13. The braking system for in-line skates of claim 11 wherein said brake housings have an internal flange for self-centering the first and second brake operating mechanisms.

14. The braking system for in-line skates of claim 11 wherein the first and second brake operating mechanisms can be activated by moving the brake arm toward said forward end of said boot.

15. The braking system for in-line skates of claim 11 wherein the first and second brake operating mechanisms can be activated by moving the brake arm toward said rearward end of said boot.

* * * * *